US010674245B2

(12) United States Patent
Chih-Hsueh et al.

(10) Patent No.: US 10,674,245 B2
(45) Date of Patent: Jun. 2, 2020

(54) OVER-EAR HEADPHONE

(71) Applicants: Richard Chih-Hsueh, San Diego, CA (US); Chung-Yeh Hsu, New Taipei (TW)

(72) Inventors: Richard Chih-Hsueh, San Diego, CA (US); Chung-Yeh Hsu, New Taipei (TW)

( * ) Notice: Subject to any disclaimer, the term of this patent is extended or adjusted under 35 U.S.C. 154(b) by 0 days.

(21) Appl. No.: 16/227,507

(22) Filed: Dec. 20, 2018

(65) Prior Publication Data

US 2020/0077171 A1 Mar. 5, 2020

Related U.S. Application Data

(60) Provisional application No. 62/726,307, filed on Sep. 2, 2018.

(30) Foreign Application Priority Data

Sep. 2, 2018 (TW) ..... 107215271 U

(51) Int. Cl.

| | |
|---|---|
| ***H04R 1/10*** | (2006.01) |
| ***F21V 33/00*** | (2006.01) |
| ***H04R 1/08*** | (2006.01) |
| *F21Y 115/10* | (2016.01) |

(52) U.S. Cl.

CPC ..... *H04R 1/1008* (2013.01); *F21V 33/0056* (2013.01); *H04R 1/08* (2013.01); *H04R 1/105* (2013.01); *H04R 1/1075* (2013.01); *H04R 1/1091* (2013.01); *F21Y 2115/10* (2016.08)

(58) Field of Classification Search

CPC ..... H04R 1/1008; H04R 1/023; H04R 1/345; H04R 1/403; H04R 3/14; F21V 33/0056

See application file for complete search history.

(56) References Cited

U.S. PATENT DOCUMENTS

| | | | | |
|---|---|---|---|---|
| 4,058,688 | A * | 11/1977 | Nishimura | H04R 1/1008 381/372 |
| 9,813,799 | B2 * | 11/2017 | Gecawicz | H04R 1/083 |
| 2015/0071456 | A1 * | 3/2015 | Steenkamp | H04R 1/1008 381/74 |
| 2016/0198256 | A1 * | 7/2016 | Bogdanov | H04R 1/2842 381/337 |

* cited by examiner

*Primary Examiner* — Sunita Joshi

(74) *Attorney, Agent, or Firm* — Rosenberg, Klein & Lee

(57) ABSTRACT

The present invention relates to an over-ear headphones comprising a headband, two earpiece modules connected to two ends of the headband, a holder and an adjustable microphone. Each of the two earpiece modules comprises an elastic case, a fixing baffle connected to the elastic case, a speaker connected to the fixing baffle, a back cover, a LED light plate at a bottom of the hack cover, and two transparent plates at an outside of the back cover. The speaker comprises a plate, a T-bar, a magnetic element, a cushion ring, a diaphragm, a voice coil and a protection cap having plural first holes arranged in a cross pattern at a central thereof, plural second holes surrounding the plural first holes, and plural third, fourth and fifth holes sequentially and radially arranged thereon for surrounding the plural second holes.

11 Claims, 9 Drawing Sheets

OVER-EAR HEADPHONE

CROSS REFERENCE TO RELATED APPLICATION

This application claims the benefits from U.S. Provisional Application No. 62/726,307, filed on Sep. 2, 2018, the subject matter of which is incorporated herein by reference. This application claims the benefits from Taiwan Application No. 107215271, filed on Nov. 9, 2018, the subject matter of which is incorporated herein by reference.

BACKGROUND OF THE INVENTION

1. Field of the Invention

The present invention relates to an over-ear headphone which has a front cavity to cover up ears of a user tightly and a back cavity with an excellent sealing effect so as to prevent sound leakage and provide a great listening experiment.

2. Description of Related Art

A headphone delivers a sound from a sound-producing device to ears of a user directly and thus can be considered as a mini speaker. Plural kinds of headphones are developed such as earbuds, in-ear headphone and over-ear headphone. Compared to other kinds of headphone, the over-ear headphone covers up ears of a user to generate a larger sound field or a larger resonance cavity, so it provides a better performance at a low frequency sound. However, a sound effect provided by the over-ear headphone is affected by an ear-covering status and a sound flow transmission status inside earpiece modules of the over-ear headphone. Thus, the development of the over-ear headphones that provide sound effects focus on improving the ear-covering status and the sound flow transmission status inside earpiece modules.

SUMMARY OF THE INVENTION

The present invention provides an over-ear headphone having a headband, two earpiece modules, a holder and an adjustable microphone. The two earpiece modules comprise a left module and a right module respectively connected to two ends of the headband. The holder is connected to an outside of the left module by one end and the adjustable microphone by the other end.

Each of the left module and the right module comprises an elastic case, a fixing baffle, a speaker and a back cover. The fixing baffle is connected to one side of the elastic case and has a penetrating hole at a central region thereof and a fixing element at a wall of the penetrating hole. The speaker is connected to the fixing element at the wall of the penetrating hole of the fixing baffle. The back cover is connected to the fixing baffle and the elastic case.

The speaker comprises a plate, a T-bar, a magnetic element, a cushion ring, a diaphragm, a voice coil and a protection cap. The plate has a concaved slot on one side thereof and the diaphragm is disposed in the concaved slot. The protection cap covers up the concaved slot and has plural first holes of a first diameter arranged into a cross pattern at a center thereof, plural second holes of a second diameter surrounding the plural first holes, plural third holes of a third diameter surrounding the plural second holes, plural fourth holes of a fourth diameter surrounding the plural third holes, and plural fifth holes of a fifth diameter surrounding the plural fourth holes and scattered on the protection cap.

According to an embodiment of the present invention, the first diameter of the plural first holes is less than the second diameter of the plural second holes, the second diameter of each of the plural second holes is less than the third diameter of the plural third holes, the third diameter of the plural third holes is less than the fourth diameter of the plural fourth holes, and the fourth diameter of the plural fourth holes is less than the fifth diameter of the plural fifth holes.

According to an embodiment of the present invention, the elastic case comprises a first side and a second side, and the first side has an elastic ring disposed at a periphery thereof and a space defined by the elastic ring and further provided with a mesh at a bottom thereof.

According to an embodiment of the present invention, the elastic ring has a first ring portion and a second ring portion having a thickness greater than a thickness of the first ring portion, and the elastic ring is a cotton elastic ring covered with a natural leather, an artificial leather or a textile fabric.

According to an embodiment of the present invention, the second side of the elastic ring has a fixing base at a periphery thereof, and made of a hybrid of a natural leather or an artificial cortex material and a polycarbonate which is pressed at a high frequency, and the fixing baffle has a circular groove at a periphery thereof for assembling to the fixing base.

According to an embodiment of the present invention, the penetrating hole of the fixing baffle is provided with plural perforations at a periphery and plural tuning members in the plural perforations respectively.

According to an embodiment of the present invention, the tuning member is a tuning paper.

According to an embodiment of the present invention, the back cover of each of the two earpiece modules is provided with a LED light plate made of a plastic material at a bottom thereof and at least one transparent plate at an outside thereof. A sealed back cavity is defined by the LED light plate, the fixing baffle and the speaker.

According to an embodiment of the present invention, the T-bar of the speaker is disposed at a bottom center of the concaved slot at and has a first through hole at a center thereof, a surrounding wall around the first through hole, and a groove defined by the surrounding wall for accommodating the voice coil, an outer wall of the magnetic element and an outer wall of the cushion ring. The magnetic element is connected to the T-bar by one side and has a second through hole at a center thereof. The cushion ring is connected to the other side of the magnetic element and has a third through hole at a central. The voice coil is disposed on the diaphragm. The T-bar, the magnetic element, and the cushion ring are covered by the diaphragm, and the concaved slot of the plate is provided with plural ventilation apertures at a periphery of the bottom.

According to an embodiment of the present invention, the fixing baffle is provided with at least one first locking column having a first locking hole for correspondingly locking the at least one first locking column by at least one locking element for locking up the fixing baffle to the back cover.

Accordingly, the over-ear headphone of the present invention covers up ears of a user by the elastic rings of the elastic case for forming a sealed space and promoting sound effect, and the elastic case is connected to the fixing baffle tightly by the fixing base for preventing sound leakage. In addition, the sealed back cavity is formed between each of the LED light plate disposed at the bottom of the back cover of the left module and the right module and the speaker disposed on the fixing baffle. Moreover, the LED light plate at the bottom of the back cover can adjust brightness of the LED light according to an audio frequency driven by the speaker, and the light emitted from the LED light is transmitted through the transparent plate to create a waving light effect with rhythms.

DETAILED DESCRIPTION OF THE PREFERRED EMBODIMENT

To provide a thorough understanding, the purpose and advantages of the present invention will be described in detail with reference to the accompanying drawings.

Figure 1:
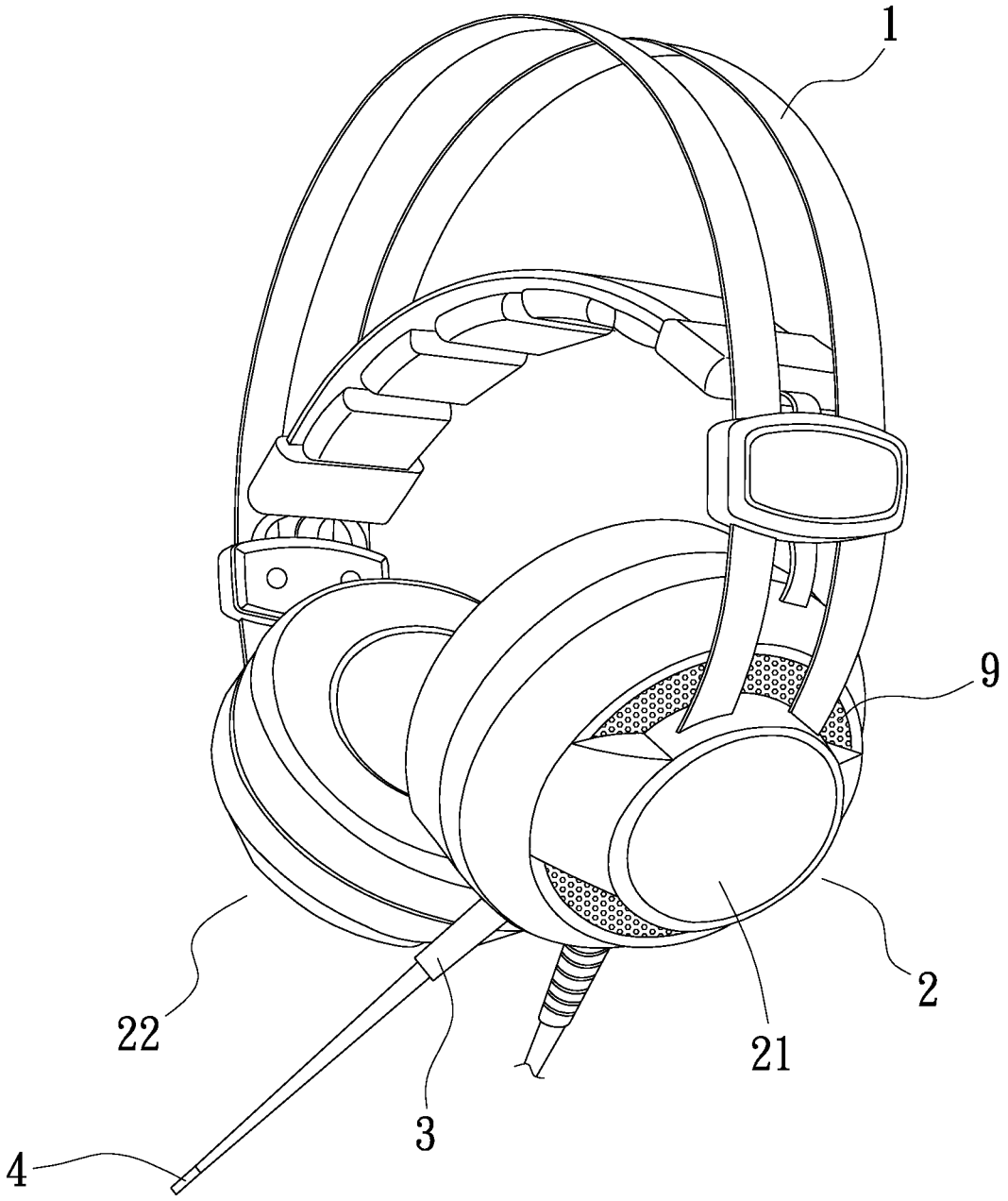
FIG. 1 is a stereogram showing an over-ear headphone of the present invention.
Figure 2:
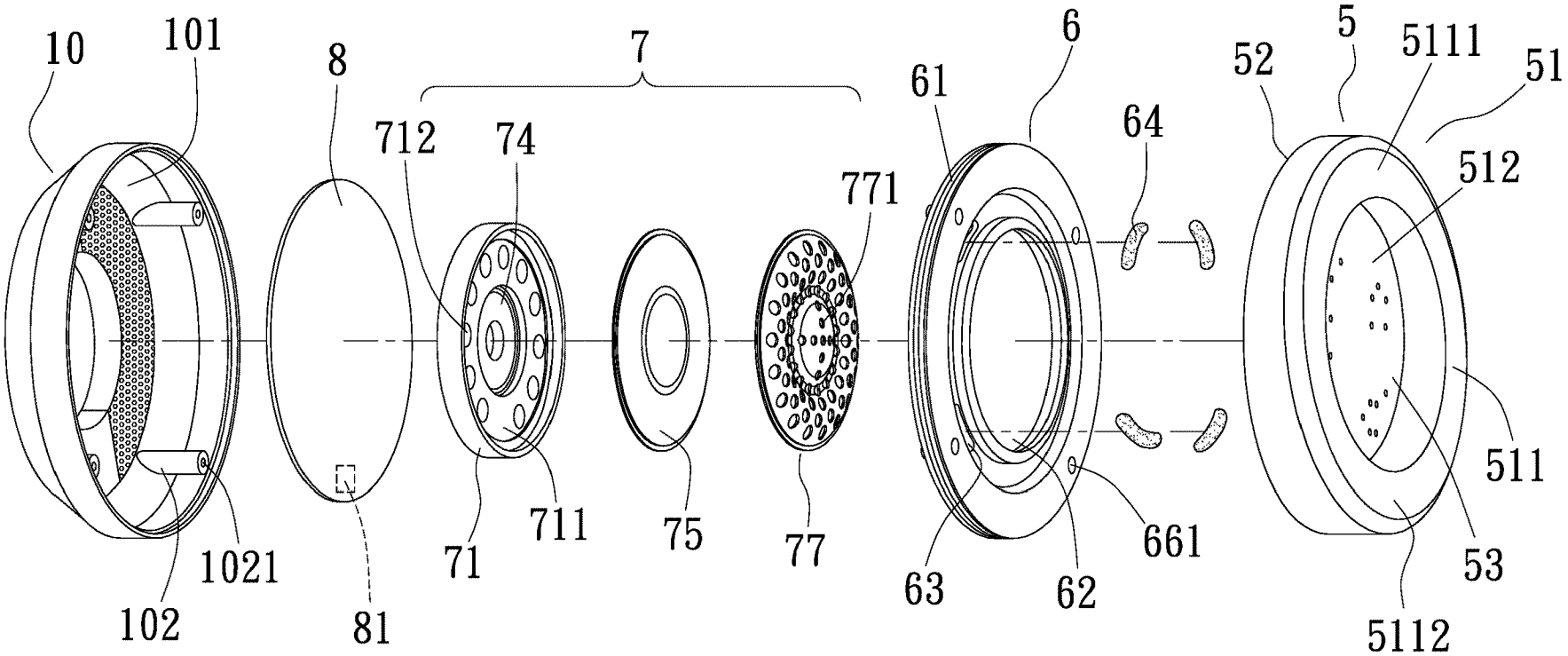
FIG. 2 is a first exploded diagram showing an earpiece module of the present invention.

Referring to FIG. 1, an ear-over headphone of the present invention comprises a headband (1), two earpiece modules (2), a holder (3) and an adjustable microphone (4). The two earpiece modules (2) comprise a left module (21) and a right module (22) and are connected to two ends of the headband (1) respectively. The holder (3) is disposed outside the left module (21) by one end, and the adjustable microphone (4) is connected to the other end of the holder (3).

Referring to FIG. 2, FIG. 3, FIG. 4 and FIG. 5, each of the left module (21) and the right module (22) comprises an elastic case (5), a fixing baffle (6), a speaker (7), a LED light plate (8), two transparent plates (9), and a back cover (10). The LED light plate (8) is made of a transparent plastic material.

The elastic case (5) comprises a first side (51) and a second side (52). The first side (51) has an elastic ring (511) disposed at a periphery thereof and a space (512) defined by the elastic ring (511). The space (512) is further provided with a mesh (53) at a bottom thereof. Referring to FIG. 2 to FIG. 6, the elastic ring (511) of the elastic case (5) has a first ring portion (5111) and a second ring portion (5112). The second ring portion (5112) has a thickness greater than a thickness of the first ring portion (5111). When wearing the present invention, the first ring portion (5111) and the second region (5112) are laid above and below an ear of a user, and the elastic ring (511) is closely attached to a skin surface around the ear of the user and covers up the ear completely due to a different thickness design of the ring portion (511). The second side (52) of the elastic case (5) is provided with a fixing base (521) at a periphery for assembling to the fixing baffle (6).

Referring to FIG. 2 to FIG. 7, the fixing baffle (6) has a circular groove (61) at a periphery, and the fixing base (521) of the elastic case (5) made of a hybrid of a natural leather or an artificial cortex material and a polycarbonate which is pressed at a high frequency, the fixing base (521) is assembled to the circular groove (61) of the fixing baffle (6) force and closely fit to a wall (611) of the circular groove (61) by an elastic tightening. The fixing baffled (6) comprises a penetrating hole (62) at a central region, and the penetrating hole (62) is provided with plural perforations (63) at a periphery of the penetrating hole (62), the perforation can be an arc-shape perforation (63). The plural perforations (63) are preferably arranged in a symmetrical manner and the number of the plural perforations (63) is preferably even, e.g., two, four, or six perforations (63). Each of the plural perorations (63) is provided with a tuning member (64), and the tuning member (64) can be a tuning paper.

Figure 5:
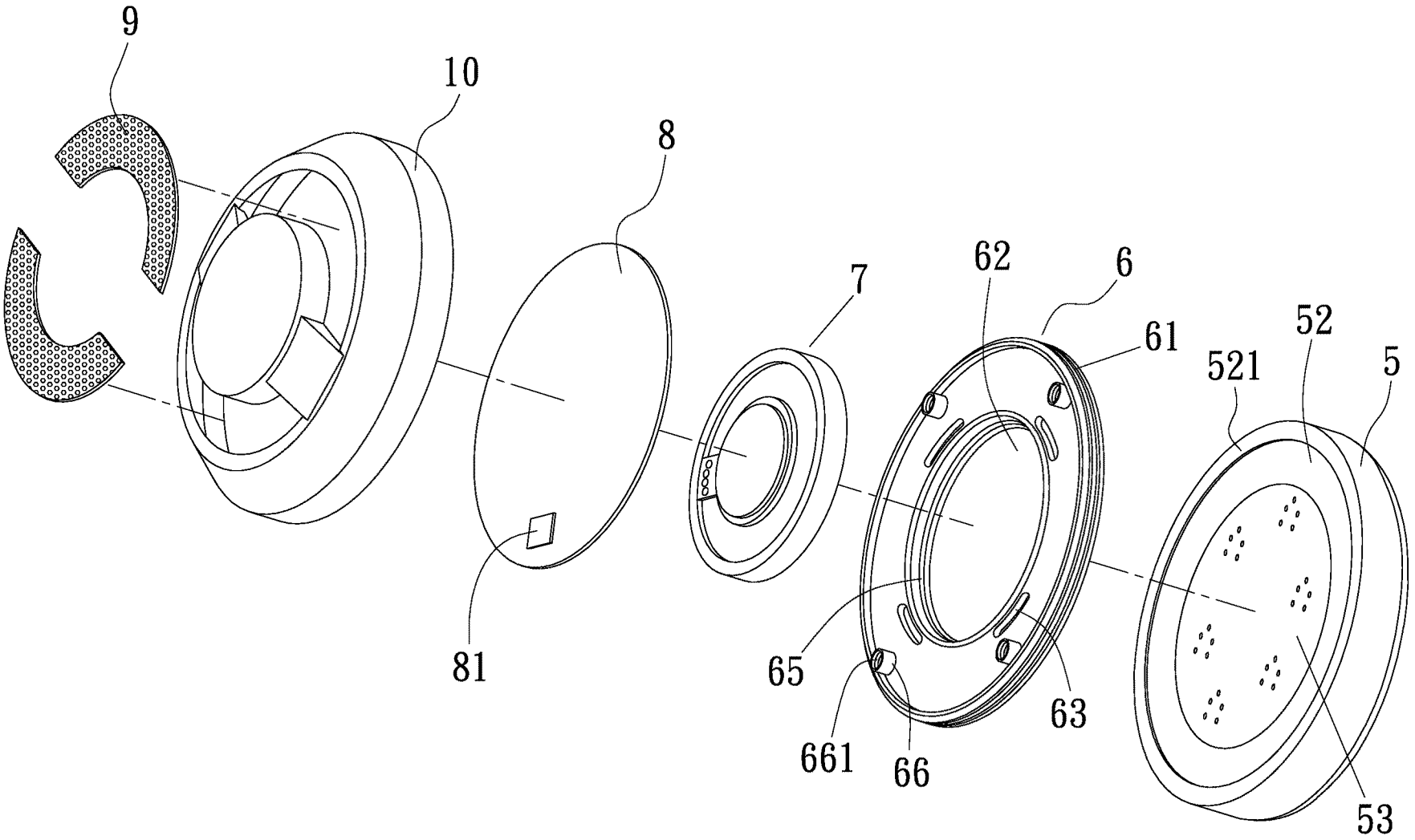
FIG. 5 is a fourth exploded diagram showing an earpiece module of the present invention.
Figure 6:
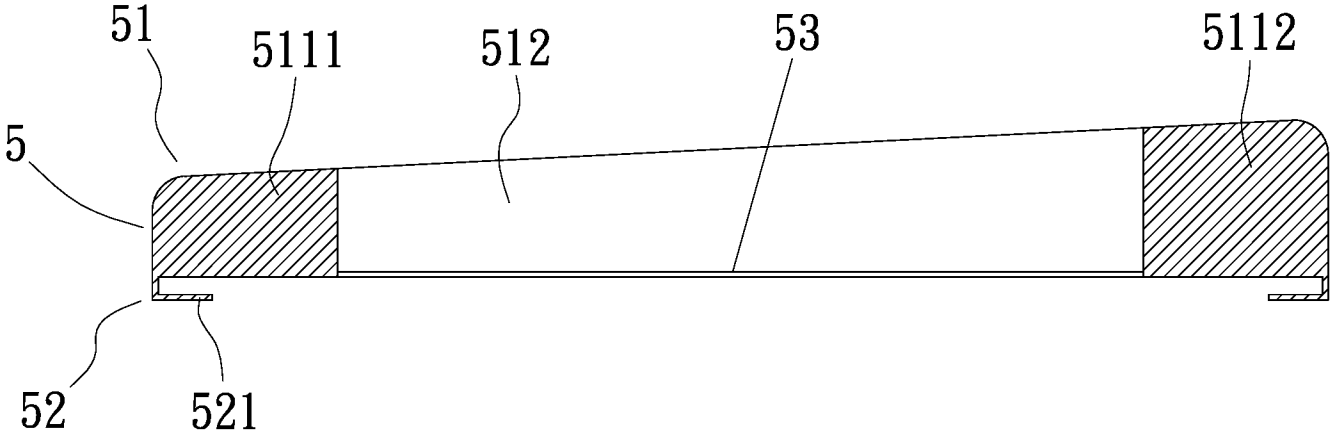
FIG. 6 is a side view showing an elastic case of the present invention.
Figure 7:
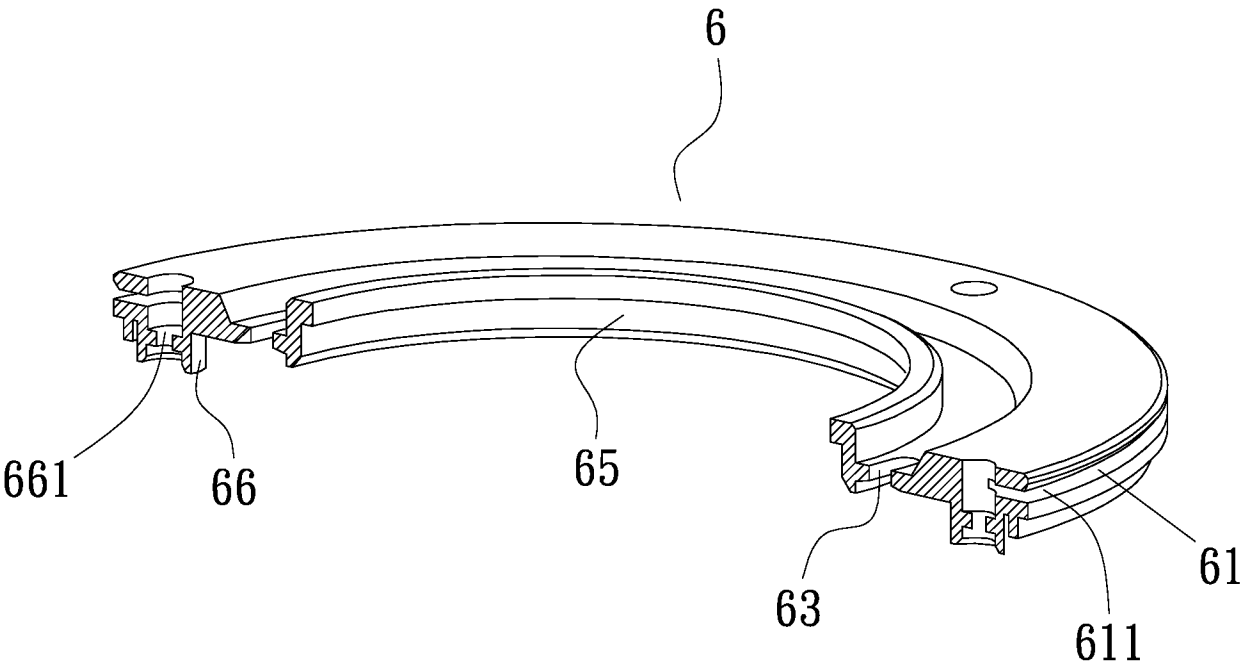
FIG. 7 is a sectional stereogram showing a fixing baffle of the present invention.
Figure 8:
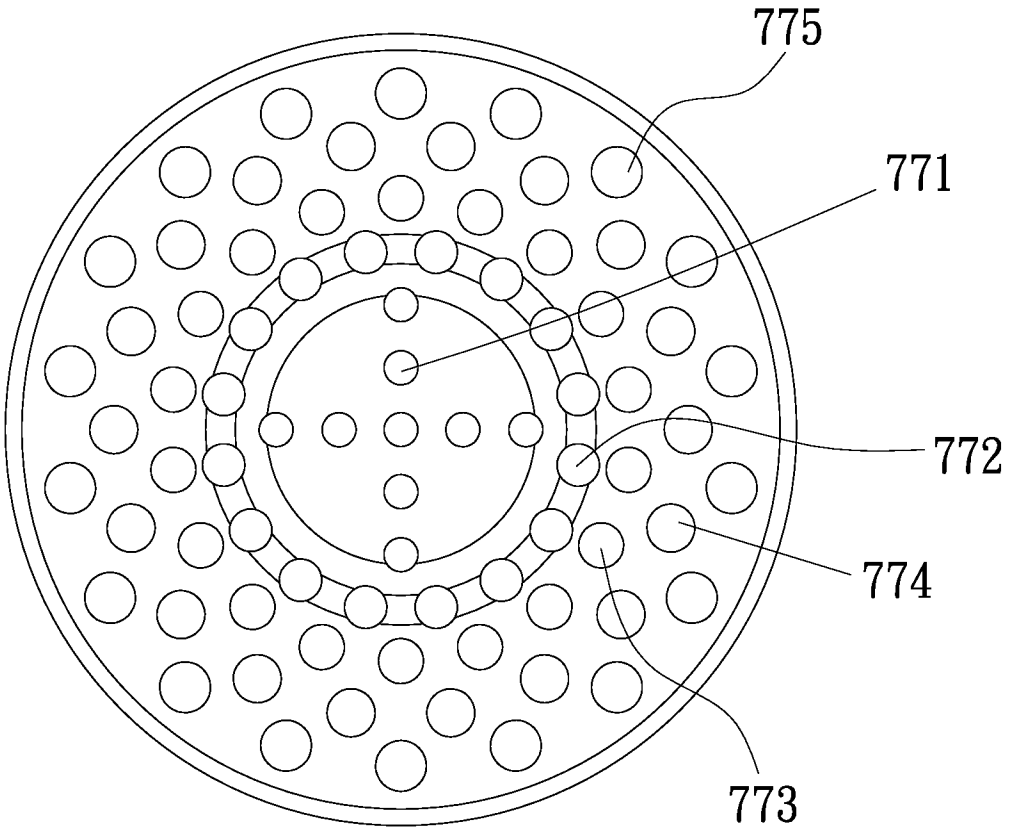
FIG. 8 is schematic diagram showing plural holes arranged on a protection cap of the present invention.
Figure 9:
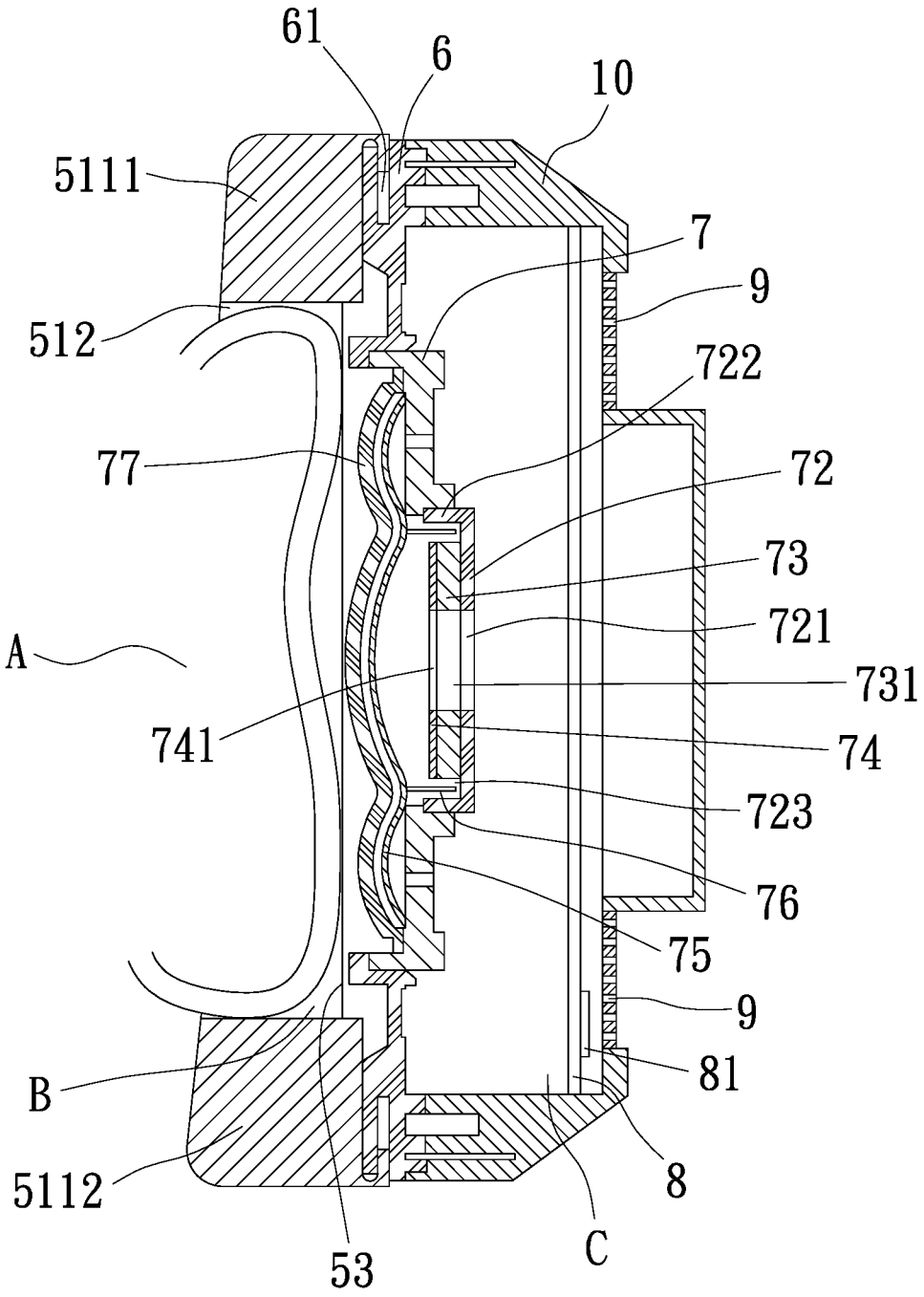
FIG. 9 is a sectional view showing an earpiece module of the present invention in use.

The speaker (7) is assembled to the penetrating hole (62) of the fixing baffle (6). Referring to FIG. 5 and FIG. 9, the penetrating hole (62) of the fixing baffle (6) has a fixing element (65) on a wall thereof, and the speaker (7) is assembled to the fixing element (65). The speaker (7) comprises a plate (71), a T-bar (72), a magnetic element (73), a cushion ring (74), a diaphragm (75), a voice coil (76) and a protection cap (77). The plate (71) has a concaved slot (711) on one side, a positioning slot at a bottom center of the concaved slot (711), and plural ventilation apertures (712) at a periphery of the bottom center of the plate (71). The T-bar (72) is disposed in the positioning slot of the concaved slot (711) and has a first through hole (721) at a center and a surrounding wall (722) around the first through hole (721). The magnetic element (73) has a second through hole (731) at a center and is connected to the T-bar (72) by one side. The other side of the magnetic element (73) is connected to the cushion ring (74) which has a third through hole (741) at a center. A groove (723) is defined by the surrounding wall (722) of the T-bar (72), an outer wall of the magnetic element (73) and an outer wall of the cushion ring (74). The diaphragm (75) is disposed in the concaved slot (711) and covers the T-bar (72), the magnetic element (73), and the cushion ring (74). The voice coil (76) is disposed on one side of the diaphragm (75) facing to the cushion ring (74) and the magnetic element (73) and is accommodated in the groove (723). The protection cap (77) is disposed at the other side of the diaphragm (75) and covers up the concaved slot (711). Referring to FIG. 8, the protection cap (77) comprises plural first holes (771) of a first diameter arranged in a cross pattern at a center thereof, plural second holes (772) of a second diameter surrounding the plural first holes (771), plural third holes (773) of a third diameter surrounding the plural second holes (772), plural fourth holes (774) of a fourth diameter surrounding the plural third holes (773), and plural fifth holes (775) of a fifth diameter surrounding the plural fourth holes (774) and scattered on the protection cap (77). The first diameter is less than the second diameter, the second diameter is less than the third diameter, the third diameter is less than the fourth diameter and the fourth diameter is less than the fifth diameter.

Figure 3:
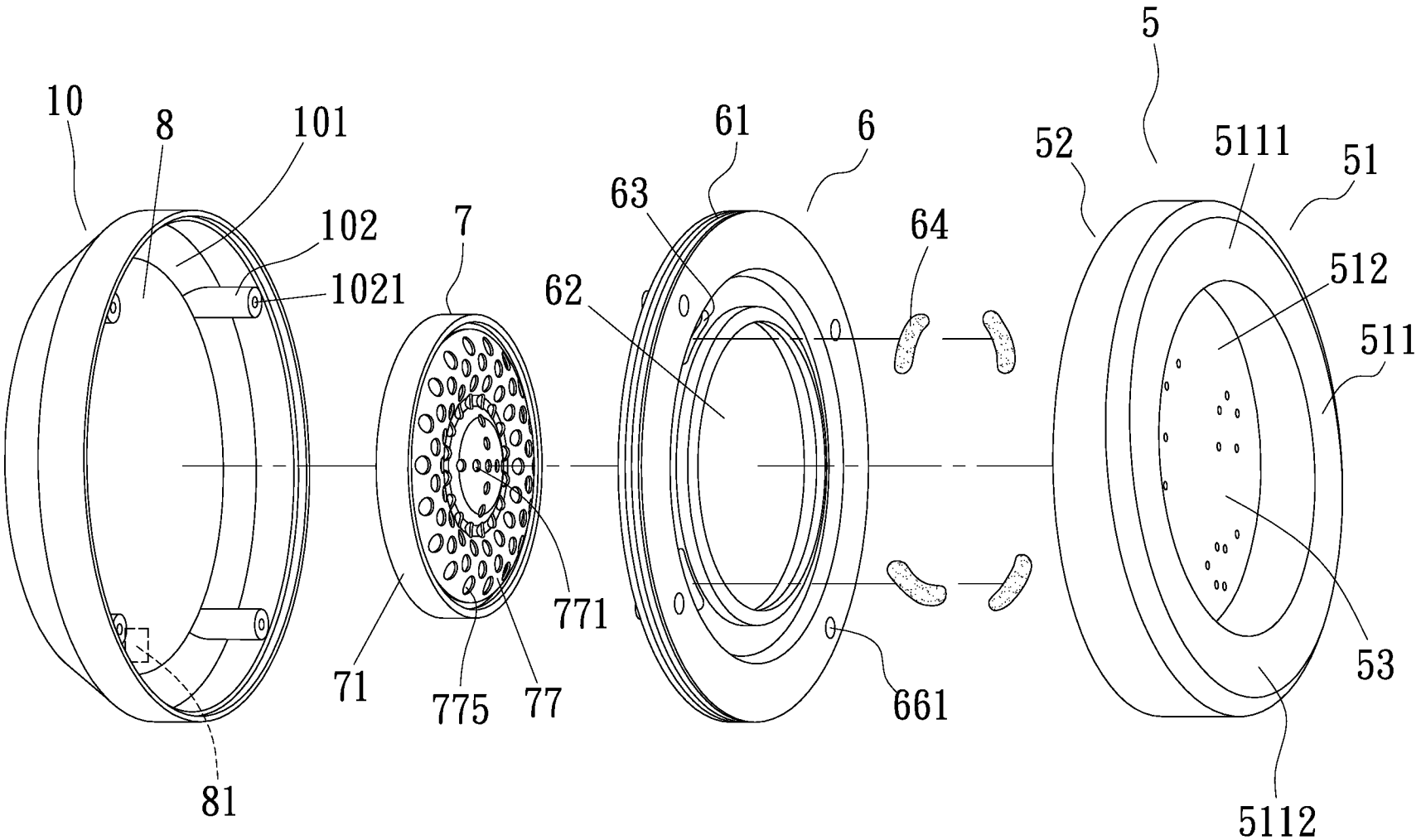
FIG. 3 is a second exploded diagram showing an earpiece module of the present invention.
Figure 4:
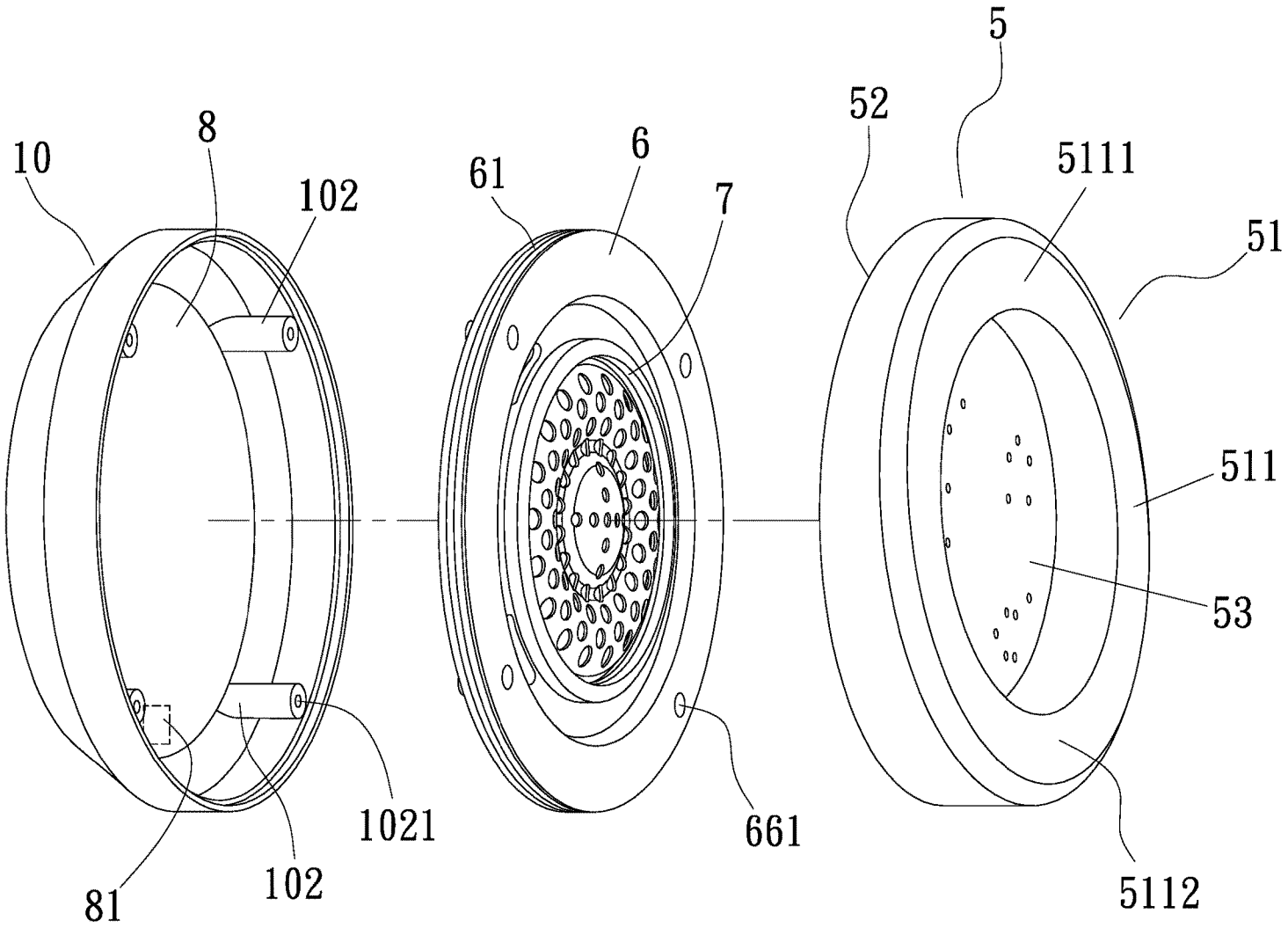
FIG. 4 is a third exploded diagram showing an earpiece module of the present invention.

Referring to FIG. 3 to FIG. 5, the back cover (10) comprises a cavity (101) at one side. The LED light plate (8) is disposed at a bottom of the back cover (10) in the cavity (101). The back cover (10) is connected to the fixing baffle (6) by the side having the cavity (101). The fixing baffle (6) is provided with at least one first locking column (66) having a first locking hole (661) passing through the first locking column (66), and the back cover (10) is provided with at least one second locking column (102) having a second locking hole (1021) for correspondingly locking the at least one first locking column (66) by at least one locking element for locking up the fixing baffle (6) to the back cover (10). The back cover (10) connected to the fixing baffle (6) is then assembled to the elastic case (5) to obtain the earpiece module (2) of the present invention.

When wearing the present invention, the headband (1) is disposed on head of the user and a left ear and a right ear of the user are covered by the two earpiece modules (2) respectively. Referring to FIG. 9, the ear (A) is covered by the elastic ring (511) of the elastic case (5) and accommodated by the space (512). The first ring portion (5111) is laid above the ear (A) and the second ring portion (5112) is laid below the ear (A) for tightly covering the ear (A) by the elastic ring (511), and a front cavity (B) is defined by the elastic case (5) and the ear (A) of the user covered by the elastic ring (5). The fixing base (521) of the elastic case (5) is made of hybrid of a natural leather or an artificial cortex material and a polycarbonate which is pressed at a high frequency, so the fixing base (521) made of the hybrid is assembled to the circular groove (61) of the fixing baffle (6) by an elastic tightening force to fit the fixing base (521) to the wall (611) of the circular groove (61) tightly and prevent a leakage of a sound flow transmitted form the speaker (7) to the front cavity (B). Therefore, the sound flow is transmitted to the ear (A) of the user efficiently so as to increase a sound quality and provide a best sense of sound field to the user. After the earpiece module (2) is assembled, a back cavity (C) is defined by the by the LED light plate (8) disposed at a bottom of the back cover (10), the fixing baffle (6) and the speaker (7) assembled with the fixing baffle (6). The plural perforations (63) of the fixing baffle (6) and the tuning members (64) in the perforations (63) adjust a pressure in the front cavity (B) and the back cavity (C) to optimize a pressure ratio of the front cavity (B) and the back cavity (C). So, the sound flow in the front cavity (B) is not easily transmitted to the back cavity (C) and the sound flow in the front cavity (B) is reflected physically therein to provide a sound field having better effect, restore an original sound efficiently and preserve a surrounded sound effect. In addition, a high frequency, medium frequency or a low frequency sound effect in the front cavity (B) is also affected by a material property of the tuning paper e.g., a density of the tuning paper. Furthermore, a surface curve of the diaphragm (75) is parallel to a surface curve of the protection cap (77), and a distance ratio between the diaphragm (75) and the protection cap (77) also optimize a reflection effect of the sound flow generated by the diaphragm (75).

Referring to FIG. 5 and FIG. 9, the back cover (10) is provided with two transparent plates (9) at a bottom and one side of the LED light plate (8) facing to the transparent plate (9) is provided with at least one LED light (81). Since the LED light plate (8) is made of a transparent plastic material, the light emitted from the LED light (81) is transmitted through the LED light plate (8). Furthermore, brightness of the light emitted from the LED light (81) is altered according to an audio frequency driven by the speaker (7), and a waving light effect with rhythms is generated by the light emitted from the LED light (81) and transmitted through the two transparent plates (9).

According to the description above, the over-ear headphone of the present invention comprises advantages below:

1. The elastic ring of the elastic case of the present invention has ring portions having different thickness, so the elastic ring is attached to the skin surface around the ear of the user closely and tightly to prevent sound leakage from the front cavity and influence of a sound effect.

2. The fixing seat of the elastic case of the present invention is made of a hybrid of a natural leather or an artificial cortex material and a polycarbonate which is pressed at a high frequency, so the fixing base made of the hybrid is assembled to the wall of the circular groove by an elastic tightening force of the fixing base to increase the tightness therebetween and prevent sound leakage from the front cavity.

3. The perforations disposed on the fixing baffle and the tuning papers on the perorations optimize a pressure ratio of the front cavity and the back cavity and affect frequency of the sound in the front cavity and the back cavity.

4. The protection cap of the speaker of the present invention is provided with plural first holes arranged in a cross pattern at a central thereof, plural second holes surrounding the plural first holes, and plural third, fourth and fifth holes sequentially and radially arranged thereon for surrounding the plural second holes; diameters of the plural holes are increased sequentially from the holes disposed at a center to the holes disposed at a periphery of the protection cap which indicates that the first hole in the center has a shortest diameter and the fifth hole at the periphery has a longest diameter; when a sound flow having high, medium and low frequency is emitted from a center of the diaphragm, the sound flow is transmitted through the plural holes and affect a performance of the sound flow having high, medium and low frequency.

5. The fixing baffle of the present invention is provided with at least one first locking column having the first locking hole, and the back cover is provided with at least one second locking column having a second locking hole for correspondingly locking the at least one first locking column by at least one locking element for locking up the fixing baffle to the back cover. Therefore, a sealed back cavity is defined by the LED light plate at a bottom of the back cover, the speaker and the fixing baffle for optimizing sound transmission.

What is claimed is:

1. An over-ear headphone, comprising:

a headband;

two earpiece modules including a left module and a right module respectively connected to two ends of the headband, wherein each of the left module and the right module includes an elastic case, the elastic case having a first side and a second side, the first side including an elastic ring disposed at a periphery thereof, a space is defined by the elastic ring, a mesh is disposed at a bottom of the space, the elastic ring including a first ring portion and a second ring portion having a thickness greater than a thickness of the first ring portion, the elastic ring being a cotton elastic ring covered with a natural leather, an artificial leather, or a textile fabric; a fixing baffle connected to one side of the elastic case and having a penetrating hole at a central region thereof and a fixing element at a wall of the penetrating hole, a speaker connected to the fixing element at the wall of the penetrating hole of the fixing baffle, and a back cover connected to the fixing baffle and the elastic case, and wherein the speaker includes a plate having a concaved slot on one side thereof, a T-bar, a magnetic element, a cushion ring, a diaphragm disposed in the concaved slot, a voice coil, and a protection cap covering up the concaved slot and having plural first holes of a first diameter arranged in a cross pattern at a center thereof, plural second holes of a second diameter surrounding the plural first holes, plural third holes of a third diameter surrounding the plural second holes, plural fourth holes of a fourth diameter surrounding the plural third holes, and plural fifth holes of a fifth diameter surrounding the plural fourth holes and scattered on the protection cap;

a holder disposed outside the left module; and an adjustable microphone connected to the holder.

2. The over-ear headphone as claimed in claim 1, wherein the first diameter is less than the second diameter, the second diameter is less than the third diameter, the third diameter is less than the fourth diameter, and the fourth diameter is less than the fifth diameter.

3. The over-ear headphone as claimed in claim 1, wherein the second side of the elastic ring has a fixing base at a periphery thereof and made of a hybrid of a natural leather or an artificial cortex material and a polycarbonate which is pressed at a high frequency, and the fixing baffle has a circular groove at a periphery thereof for assembling the fixing base.

4. The over-ear headphone as claimed in claim 1, wherein the penetrating hole of the fixing baffle is provided with plural perforations at a periphery thereof and plural tuning members in the plural perforations respectively.

5. The over-ear headphone as claimed in claim 4, wherein the tuning element is a tuning paper.

6. The over-ear headphone as claimed in claim 1, wherein the back cover of each of the two earpiece modules is provided with a LED light plate at a bottom thereof and at least one transparent plate at an outside thereof, and wherein the LED light plate, the fixing baffle and the speaker define a sealed back cavity.

7. The over-ear headphone as claimed in claim 1, wherein the T-bar of the speaker is disposed at a bottom center of the concaved slot and having a first through hole at a center thereof, the T-bar having a surrounding wall around the first through hole, and a groove defined by the surrounding wall for accommodating the voice coil, an outer wall of the magnetic element and an outer wall of the cushion ring are defined; the magnetic element having one side connected to the T-bar, the magnetic element having a second through hole at a center region thereof and the other side of the magnetic element is connected to the cushion ring having a third through hole at a center thereof; the voice coil disposed on the diaphragm; the diaphragm covered on the T-bar, the magnetic element, and the cushion ring; and wherein the concaved slot of the plate is provided with plural ventilation apertures at a periphery of the bottom.

8. The over-ear headphone as claimed in claim 1, wherein the fixing baffle is provided with at least one first locking column having a first locking hole, and the back cover is provided with at least one second locking column having a second locking hole for correspondingly locking the at least one first locking column by at least one locking element for locking up the fixing baffle to the back cover.

9. An over-ear headphone, comprising:

a headband;

two earpiece modules including a left module and a right module respectively connected to two ends of the headband, wherein each of the left module and the right module includes an elastic case, the elastic case having a first side and a second side, the first side including an elastic ring disposed at a periphery thereof, a space defined by the elastic ring, a mesh is disposed at a bottom of the space, the second side of the elastic ring including a fixing base at a periphery thereof and being made of a hybrid of a natural leather or an artificial cortex material and a polycarbonate which is pressed at a high frequency, a fixing baffle connected to one side of the elastic case and having a penetrating hole at a central region thereof and a fixing element at a wall of the penetrating hole, the fixing baffle having a circular groove at a periphery thereof for assembling the fixing base, a speaker connected to the fixing element at the wall of the penetrating hole of the fixing baffle, and a back cover connected to the fixing baffle and the elastic case, and wherein the speaker includes a plate having a concaved slot on one side thereof, a T-bar, a magnetic element, a cushion ring, a diaphragm disposed in the concaved slot, a voice coil, and a protection cap covering up the concaved slot and having plural first holes of a first diameter arranged in a cross pattern at a center thereof, plural second holes of a second diameter surrounding the plural first holes, plural third holes of a third diameter surrounding the plural second holes, plural fourth holes of a fourth diameter surrounding the plural third holes, and plural fifth holes of a fifth diameter surrounding the plural fourth holes and scattered on the protection cap;

a holder disposed outside the left module; and an adjustable microphone connected to the holder.

10. An over-ear headphone, comprising:

a headband;

two earpiece modules including a left module and a right module respectively connected to two ends of the headband, wherein each of the left module and the right module includes an elastic case, a fixing baffle connected to one side of the elastic case and having a penetrating hole at a central region thereof and a fixing element at a wall of the penetrating hole, the penetrating hole of the fixing baffle is provided with plural perforations at a periphery thereof and plural tuning members in the plural perforations respectively, a speaker connected to the fixing element at the wall of the penetrating hole of the fixing baffle, and a back cover connected to the fixing baffle and the elastic case, and wherein the speaker includes a plate having a concaved slot on one side thereof, a T-bar, a magnetic element, a cushion ring, a diaphragm disposed in the concaved slot, a voice coil, and a protection cap covering up the concaved slot and having plural first holes of a first diameter arranged in a cross pattern at a center thereof, plural second holes of a second diameter surrounding the plural first holes, plural third holes of a third diameter surrounding the plural second holes, plural fourth holes of a fourth diameter surrounding the plural third holes, and plural fifth holes of a fifth diameter surrounding the plural fourth holes and scattered on the protection cap;

a holder disposed outside the left module; and an adjustable microphone connected to the holder.

11. An over-ear headphone, comprising:

a headband;

two earpiece modules including a left module and a right module respectively connected to two ends of the headband, wherein each of the left module and the right module includes an elastic case, a fixing baffle connected to one side of the elastic case and having a penetrating hole at a central region thereof and a fixing element at a wall of the penetrating hole, a speaker connected to the fixing element at the wall of the penetrating hole of the fixing baffle, and a back cover connected to the fixing baffle and the elastic case, and wherein the speaker includes a plate having a concaved slot on one side thereof, a T-bar, a magnetic element, a cushion ring, a diaphragm disposed in the concaved slot, a voice coil, and a protection cap covering up the concaved slot and having plural first holes of a first diameter arranged in a cross pattern at a center thereof, plural second holes of a second diameter surrounding the plural first holes, plural third holes of a third diameter surrounding the plural second holes, plural fourth holes of a fourth diameter surrounding the plural third holes, and plural fifth holes of a fifth diameter surrounding the plural fourth holes and scattered on the protection cap, wherein the T-bar of the speaker is disposed at a bottom center of the concaved slot and having a first through hole at a center thereof, the T-bar having a surrounding wall around the first through hole, and a groove defined by the surrounding wall for accommodating the voice coil, an outer wall of the magnetic element and an outer wall of the cushion ring are defined; the magnetic element having one side connected to the T-bar, the magnetic element having a second through hole at a center region thereof and the other side of the magnetic element is connected to the cushion ring having a third through hole at a center thereof; the voice coil disposed on the diaphragm; the diaphragm covered on the T-bar, the magnetic element, and the cushion ring; and wherein the concaved slot of the plate is provided with plural ventilation apertures at a periphery of the bottom;

a holder disposed outside the left module; and an adjustable microphone connected to the holder.

* * * * *